United States Patent [19]

Engstrom et al.

[11] 4,369,719

[45] Jan. 25, 1983

[54] VERMICULITE AS A DEPOSIT MODIFIER IN COAL FIRED BOILERS

[75] Inventors: Gary G. Engstrom, Kenosha, Wis.; Douglas I. Bain, Cincinnati, Ohio

[73] Assignee: Dearborn Chemical Company, Lake Zurich, Ill.

[21] Appl. No.: 207,006

[22] Filed: Nov. 14, 1980

[51] Int. Cl.[3] ..... F23J 11/00

[52] U.S. Cl. ..... 110/345; 110/343

[58] Field of Search ..... 110/342, 343, 344, 345; 44/4, 5; 423/244

[56] References Cited

U.S. PATENT DOCUMENTS

| | | | |
|---|---|---|---|
| 3,090,764 | 5/1963 | Ellis et al. | 260/28.5 |
| 3,145,019 | 8/1964 | Clute | 263/21 |
| 3,249,075 | 5/1966 | Nelson et al. | 110/343 |
| 4,069,284 | 1/1978 | Niimi et al. | 264/43 |
| 4,245,573 | 1/1981 | Dixit et al. | 110/344 X |

OTHER PUBLICATIONS

Grim, *Vermiculite,* Applied clay Mineralogy, McGraw-Hill, 1962, p. 25.

Libutti, "Efficient Cold-End Additives", Am. Chem. Soc., Div. Fuel Chem., Preprints (ACFPAI), vol. 21(1), pp. 23-34 (1976).

*Primary Examiner*—Edward G. Favors

*Attorney, Agent, or Firm*—Mark T. Collins

[57] ABSTRACT

Uncalcined vermiculite is injected into the coal fired furnace, at 3000°-1200° F., thereby facilitating removal of deposits that accumulate on line within the furnace.

8 Claims, No Drawings

VERMICULITE AS A DEPOSIT MODIFIER IN COAL FIRED BOILERS

Use of the present invention facilitates removal of deposits that form on the walls and heat-exchange surfaces in an industrial furnace or utility boiler burning coal. This is accomplished by injecting uncalcined vermiculite into the flue gas stream where the stream has a temperature of about 3000° F. to 1200° F., at a rate of 0.05 to 10.0 pounds of vermiculite (preferably 1–3 lbs.) per short ton of coal burned. The vermiculite increases the friability of the deposits, making them easier to remove by conventional soot blowers (i.e., probes located within the boiler blowing in air or steam at about 200 psig.)

The mineral matter (ash) in coal leads to deposits in the heat absorbing regions of the boiler, particularly the superheater and convection passes. These sintered fly ash deposits can be stronger than the potential of conventional cleaning equipment. We have discovered that the injection of vermiculite will reduce the strength of deposits in order to maintain clean heat exchange surfaces and prevent the eventual blockage of these passages.

Vermiculite, a natural occurring mineral, expands 15–20 times its original volume when exposed to temperatures in excess of approximately 1200° F. This greatly reduces the strength of sintered (bonded) deposits in which vermiculite is present. In the past, the chemical and physical properties of materials such as magnesium oxide, alumina, etc., have been employed to interfere with sintered deposits. Vermiculite is superior to these additives.

Vermiculite, a hydrated magnesium-aluminum-iron silicate, consists of 14 closely related micaceous minerals. When unexfoliated vermiculite is applied in such a manner as to be incorporated in the ash deposit and subjected to temperatures in the range encountered in superheater and convection regions, a dramatic reduction in the strength of the bonded deposit is evident. The unique properties which account for this activity include thermally induced exfoliation (expansion) and the presence of a naturally occurring platelet structure (silica sheets) which acts as a cleave plane. Deposits can be removed with greater ease as a result of this treatment.

EXAMPLE I

The boiler has a 347 megawatt design capacity. It is cyclone fired and burns Eastern bituminous c coal. It is equipped with soot blowers. Unexpanded vermiculite is blown into the furnace at 2600° F. at the rate of 0.6–0.8 lbs./ton of coal. The additive causes the in-line deposits to be relatively friable and readily removed by the soot blowers at 200 psig.

In contrast, in a comparable run but omitting the vermiculite, the deposits are hard, sintered, and bonded, making them difficult to loosen and dislodge with the steam probes.

We prefer that the vermiculite be relatively finely divided, e.g., mostly 3 to 325 mesh (Tyler screen), and even more preferably, mostly 28 to 200 mesh. The product in the above example is and in the Tables was mostly about 80–150 mesh.

SOLIDS ADDITION APPARATUS

In the above example a water-cooled probe is used to inject the vermiculite into the furnace. The probe is about 5 feet long and consists of 3 concentric tubes made of 3/16" stainless steel. The outer tube is 2.5 inches outer diameter, the middle tube 2 inches, the center tube 1 inch. Water flows down the annulus formed by the outer and middle tubes and returns via the annulus formed by the middle and center tubes. There is about 0.277 inches clearance between the terminus of the outer tube and the terminus of the middle tube to permit water return. Water is introduced in the front end of the outer tube, outside the boiler. The incoming flow is lateral, so that the water spins tangentially on its way down the tube. The vermiculite is taken off a hopper with a screw feeder which meters the vermiculite into an air conveying system, which delivers the vermiculite to the center tube of the probe. The air flow helps cool the center tube and may also contribute to cooling the water jacketed areas of the probe.

The Sintering Test developed by Babcock and Wilcox has been employed to determine the fouling tendency (formation of bonded deposits) of various ashes and the effect of additives. See "The Sintering Test, An Index to Ash-Fouling Tendency" by D. H. Barnhart and P. C. Williams, Transactions of the ASME, August, 1956, p. 1229. Briefly, the test consists of forming the ash into pellets, heating to various elevated temperatures for 15 hours, and measuring the force required to crush the resulting sintered samples. Table 1 summarizes the results obtained without additive, with various levels of vermiculite, and with magnesium oxide. Magnesium oxide was found to have the greatest effect in work done by Babcock and Wilcox and is included for comparison. Table 2 lists the corresponding percent reduction in sinter strength for the samples tested. The results show the dramatic effect that vermiculite has in deposit modifications.

TABLE 1

| | Sinter Strength of Pellets, psi | | | |
|---|---|---|---|---|
| | 1800° F. | | 2000° F. | |
| Blank | 10,800 | 15,200 | 13,400 | 25,600 |
| (no treatment) | 13,000 | 14,500 | 7,756 | 22,400 |
| | 11,200 | 15,300 | 24,900 | 19,300 |
| Average Blank | 13,333 | | 18,893 | |
| Vermiculite, 0.5% | 6,570 | 9,810 | 12,800 | 14,100 |
| | 9,980 | 10,300 | 12,200 | 14,300 |
| | 7,650 | | 8,660 | |
| Average 0.5% | 8,862 | | 12,412 | |
| Vermiculite, 1.0% | 6,490 | 7,190 | 6,140 | 6,130 |
| | 5,190 | 5,300 | 6,090 | 6,810 |
| | 6,560 | 10,000 | 5,850 | 6,930 |
| Average 1.0% | 6,788 | | 6,325 | |
| Vermiculite, 1.5% | 4,960 | 4,510 | 4,880 | 4,480 |
| | 4,990 | 3,950 | 4,950 | 3,890 |
| | 5,540 | 3,770 | 4,190 | 4,270 |
| Average 1.5% | 4,620 | | 4,443 | |
| Magnesium Oxide, 1.5% | 8,300 | 8,100 | 12,900 | 13,500 |
| | 6,720 | 6,470 | 10,300 | 10,500 |
| | 8,500 | 5,170 | 14,500 | |
| Average 1.5% MgO | 7,210 | | 12,340 | |

TABLE 2

| | Average Reduction in Sinter Strength, % | |
|---|---|---|
| | 1800° F. | 2000° F. |
| Blank | — | — |
| Vermiculite, 0.5% | 33.5 | 34.3 |
| Vermiculite, 1.0% | 49.1 | 66.5 |
| Vermiculite, 1.5% | 65.4 | 76.5 |

TABLE 2-continued

| | Average Reduction in Sinter Strength, % | |
|---|---|---|
| | 1800° F. | 2000° F. |
| Magnesium Oxide, 1.5% | 45.9 | 34.7 |

We claim:

1. Method of rendering fly ash deposits in a coal-fired furnace more friable, thereby facilitating their removal by steam or air probe, comprising injecting uncalcined vermiculite into the furnace at 3000°–1200° F.

2. Method according to claim 1 in which the vermiculite is injected at the rate of about 1 to 3 pounds per short ton of coal.

3. Method according to claim 1 in which the vermiculite is about 80 to 150 mesh.

4. Method according to claim 1, claim 2, or claim 3 in which the temperature of injection is about 2600° F.

5. Method according to claim 1, claim 2, or claim 3 in which the furnace is a boiler having a superheater and convection passes and the vermiculite is injected into the boiler so that vermiculite is incorporated in the deposits on the superheater and convection passes.

6. Method according to claim 1 or claim 3 in which the vermiculute is injected at the rate of about 0.05 to 10.0 pounds per short ton of coal.

7. Method of rendering fly ash deposits in a coal-fired boiler having a superheater and convection passes more friable, thereby facilitating their removal by steam or air probe, comprising injecting unexfoliated vermiculite into the boiler flue gas stream at a temperature of about 3000° to 1200° F. so that vermiculite is incorporated in the deposits on the superheater and convection passes.

8. Method according to claim 7 in which the vermiculite is injected at the rate of about 0.05 to 10.0 pounds per short ton of coal.

* * * * *